US007495247B2

(12) United States Patent
Jorg

(10) Patent No.: US 7,495,247 B2
(45) Date of Patent: Feb. 24, 2009

(54) FACILITY FOR SETTING UP AND SYSTEM TESTING OF X-RAY SYSTEMS

(75) Inventor: Robert Jorg, Neunkirchen (DE)

(73) Assignee: Siemens Atiengesellschaft, Munich (DE)

( * ) Notice: Subject to any disclaimer, the term of this patent is extended or adjusted under 35 U.S.C. 154(b) by 498 days.

(21) Appl. No.: 11/045,722

(22) Filed: Jan. 28, 2005

(65) Prior Publication Data

US 2005/0166473 A1 Aug. 4, 2005

(30) Foreign Application Priority Data

Jan. 30, 2004 (DE) ..... 10 2004 004 842

(51) Int. Cl.

| | |
|---|---|
| ***G21C 11/00*** | (2006.01) |
| ***G21F 3/04*** | (2006.01) |
| ***A47H 1/00*** | (2006.01) |
| ***E04B 1/346*** | (2006.01) |
| ***E04B 7/16*** | (2006.01) |
| ***E04H 1/00*** | (2006.01) |
| ***E04H 3/00*** | (2006.01) |
| ***E04H 5/00*** | (2006.01) |
| ***E04H 6/00*** | (2006.01) |
| ***E04H 9/00*** | (2006.01) |
| ***E04H 14/00*** | (2006.01) |

(52) U.S. Cl. ..... 250/517.1; 250/515.1; 160/125; 52/67; 52/64; 52/79.1; 52/243.1

(58) Field of Classification Search ..... 52/670, 52/64, 67, 238.1, 243.1, 174, 79.1, 36.1; 250/517.1, 515.1; 49/61, 63, 65, 125; 160/123, 160/126, 113, 114, 115

See application file for complete search history.

(56) References Cited

U.S. PATENT DOCUMENTS

| | | | | |
|---|---|---|---|---|
| 1,096,446 | A * | 5/1914 | Mesker | 160/1 |
| 1,400,080 | A * | 12/1921 | Kopchuk | 160/33 |
| 1,419,241 | A * | 6/1922 | Edwards | 378/117 |
| 1,576,730 | A * | 3/1926 | Harth | 252/478 |
| 1,854,942 | A * | 4/1932 | Samuel | 250/517.1 |

(Continued)

FOREIGN PATENT DOCUMENTS

WO 2004003934F A1 1/2004

(Continued)

*Primary Examiner*—Robert J Canfield
*Assistant Examiner*—Ryan J Franks

(57) ABSTRACT

Facility for installing or for system testing of floor or ceiling-mountable x-ray systems with radiation protection cabins with radiation-proof, especially lead-lined, walls and doors, with each radiation protection cabin (1) having a sliding door (7, 7') occupying at least a majority of the cabin wall, made up of several lead-shielded door elements (7*a*, 7*b*, 7*c*) which can slide telescopically over one another and are preferably hung from a ceiling mount at a slight distance from the floor to allow them to slide freely and separate the internal operating space (5) of the cabin (1) from the operating console (4) for the x-ray system arranged in front of it, with the door elements (7*a*, 7*b*, 7*c*) being equipped with lead-shielded side edges (9) overlapping in their closed position such that radiation cannot escape from the interior of the cabin through the gap between two adjacent door elements (7*a*, 7*b*, 7*c*), and with a door closing monitoring system being provided to which the operating system of the x-ray system is connected.

12 Claims, 2 Drawing Sheets

U.S. PATENT DOCUMENTS 2,175,671 A * 10/1939 Ryan ..... 250/517.1
2,183,790 A * 12/1939 Dillehay et al. ..... 428/623
2,328,326 A * 8/1943 Byrne ..... 49/360
2,420,186 A * 5/1947 Miller et al. ..... 52/63
2,751,637 A * 6/1956 Kraft ..... 49/125
2,850,089 A * 9/1958 Burke ..... 160/202
2,895,183 A * 7/1959 Dumbolton ..... 160/197
2,999,568 A * 9/1961 Ludwig et al. ..... 52/584.1
3,055,061 A * 9/1962 Dadras ..... 52/64
3,231,451 A * 1/1966 Gazelle ..... 428/74
3,235,915 A * 2/1966 Glaser ..... 52/64
3,248,830 A * 5/1966 Maynard ..... 52/67
3,299,270 A * 1/1967 D Avella ..... 250/517.1
3,300,899 A * 1/1967 Haws et al. ..... 49/321
3,378,963 A * 4/1968 Obata ..... 52/34
3,745,725 A * 7/1973 Boucaud ..... 52/67
3,810,330 A * 5/1974 Daggy ..... 49/127
3,845,591 A * 11/1974 Stine ..... 52/67
4,038,553 A * 7/1977 McCullagh ..... 250/517.1
4,062,518 A * 12/1977 Stivender et al. ..... 250/519.1
4,074,141 A * 2/1978 Bryant ..... 250/517.1
4,514,640 A * 4/1985 Bagnell et al. ..... 250/517.1
4,644,705 A * 2/1987 Saccomani et al. ..... 52/27
4,674,241 A * 6/1987 Sarrazin ..... 52/67
4,944,169 A * 7/1990 Labelle et al. ..... 70/100
4,959,504 A * 9/1990 Yarger et al. ..... 174/386
5,643,477 A * 7/1997 Gullo et al. ..... 219/121.86
5,695,443 A * 12/1997 Brent et al. ..... 588/249
6,018,915 A * 2/2000 Pomish et al. ..... 52/64
6,278,125 B1 * 8/2001 Belek ..... 250/519.1
6,405,491 B1 * 6/2002 Gallant ..... 52/36.1
6,550,203 B1 * 4/2003 Little ..... 52/407.4
6,835,945 B2 12/2004 Mossor et al.
6,973,758 B2 * 12/2005 Zeik et al. ..... 52/561
7,030,399 B2 * 4/2006 Williamson et al. ..... 250/515.1
7,064,280 B1 * 6/2006 Rodgers ..... 174/384
7,091,508 B2 * 8/2006 Goldstein ..... 250/515.1
7,260,916 B2 * 8/2007 Sarnell et al. ..... 49/409
7,291,854 B2 * 11/2007 Bichay ..... 250/517.1
7,368,175 B2 * 5/2008 Neth ..... 428/573
2002/0023392 A1 * 2/2002 Bischof ..... 52/64
2004/0025448 A1 * 2/2004 Puusepp et al. ..... 52/64
2004/0049984 A1 * 3/2004 Pfaff ..... 49/116
2005/0252097 A1 * 11/2005 Bischof ..... 52/64
2007/0107309 A1 * 5/2007 Molteni ..... 49/125
2008/0023658 A1 * 1/2008 Bichay ..... 250/517.1
2008/0149864 A1 * 6/2008 Hargrove ..... 250/515.1

FOREIGN PATENT DOCUMENTS

WO 2004009921 A2 1/2004

* cited by examiner

FACILITY FOR SETTING UP AND SYSTEM TESTING OF X-RAY SYSTEMS

CROSS REFERENCE TO RELATED APPLICATIONS

This application claims priority to the German application No. 10 2004 004 842.8, filed Jan. 30, 2004 which is incorporated by reference herein in its entirety.

FIELD OF INVENTION

The invention relates to a facility for setting up system testing of floor and ceiling mountable x-ray systems with radiation protection cabins with radiation-proof, especially lead-lined walls.

BACKGROUND OF INVENTION

Previously radiation protection cabins have been used which are adapted to the x-ray systems to be tested, meaning that one has a plurality of different sizes of radiation protection cabins, with a significant problem being the different radiation protection systems that cannot be monitored manually. The design of the radiation protection in these existing arrangements is very maintenance-intensive and the construction below the ceiling is very non-uniform and thereby inflexible.

SUMMARY OF INVENTION

An object of the invention is thus to create a facility for setting up and system testing of x-ray systems, in which, as well as the use of standardized radiation protection cabins, a simple radiation protection is guaranteed and at the same time it is extremely easy to load equipment into the x-ray protection cabins.

To achieve this object there is provision for each radiation protection cabin to have a sliding door taking up at least a majority of the cabin wall consisting of a number of telescopic lead-lined door elements which can be moved over one another, which are preferably hung from a ceiling mount and freely slidable at a short distance from the floor and separate the internal operational area of the cabin from the operating console for the x-ray system located in front of it, for the door elements to be provided with lead-lined edges overlapping each other in the closed position such that radiation cannot escape to the outside from any point within the cabin through the gap between two adjacent door elements, and for a closure monitoring device to be provided which is linked to the operating system of the x-ray system.

The inventive embodiment of the radiation protection cabins initially produces the major advantage that one wall of the cabin can be slid open almost completely, so that large vehicles can be used to bring the individual components of the x-ray system into the cabin and also take them out of it again. This then also produces the advantage of being able to leave the x-ray system in the largest possible assembled state and send it in this state, so that the assembly at the actual installation site, that is in the hospital or medical practice, can be correspondingly simplified.

The freely slidable door elements, which by their overlapping prevent the escape of radiation, can in any event hang a few centimeters above the floor, since at no location within the cabin where an x-ray system can be positioned is a significant amount of radiation emitted downwards, with the angle of radiation emission always being such that escape underneath the lead-shielded door is not possible. In addition the door elements can also be equipped with sealing profiles facing towards the relevant neighboring door element in the area of the side edges, which adjoin each other as sliding stops when the doors are slid open, with it also being possible to arrange sensors in the area of these sealing profiles, which can be included for the closure monitoring arrangement.

The inventive closure monitoring arrangement ensures that the x-ray system can only be monitored if all door elements are closed to provide a hermetic, i.e. radiation-proof seal. If this is not the case for an element, the control system of the x-ray system is blocked and operation is not possible at all.

In an embodiment of the invention there can be provision for the cabin wall with the sliding door to include at least one fixed part with a hinged door, so that after the x-ray system has been set up, with a largely closed sliding door the subsequent fine adjustment and testing, for which frequent entry into the cabin is required, can be simplified, in that only the hinged door is used to allow the operating personnel through.

At least one door element, preferably all, and also the hinged door, can be provided with lead glass windows.

This is not only more convenient for the operating personnel engaged in installation work within the cabin, since they can see out, but also has the advantage that the testing personnel who perform the system testing from the operating console in front of the closed sliding door can observe the system during the testing and the system can be demonstrated to customers in the testing state. Experience shows that customers frequently come to the plant during the setting up and the system testing in order to view their new x-ray system beforehand in order to assess from a similar constructional arrangement how their system will look later.

In a further embodiment of the invention there is provision for the facility for setting up and system testing of x-ray systems to arrange a number of radiation protection cabins next to each other and behind one another, with the facing rear walls of the radiation protection cabins of the two rows being equipped with sliding doors.

This allows a simple arrangement with power supplied to the cabin from the rear. Only the radiation protection cabins arranged next to one another are separated from each other by solid walls, with these being able to be embodied both as concrete walls and as prefabricated walls which are then provided in the known way with radiation protection plates. The radiation protection cabins of these double rows are preferably open at the top and spanned by mounting rails, which are embodied so that the hanging of sliding doors is possible and on the other hand any conceivable assembly of ceiling mountable x-ray systems. The size of the radiation protection cabins is designed in this case such that in each cabin the assembly and system testing of each x-ray system is possible, meaning that different sizes of radiation protection cabins no longer have to be provided for individual types of x-ray systems, since these would not allow a system setup in accordance with the invention and obviously would not provide the free choice and accessibility of the radiation protection cabins which ensures an optimum operating sequence.

The system cabinets arranged within a radiation protection cabin for system testing should be arranged in the area of the rear wall behind slidable lead curtains.

In addition it also falls within the framework of the invention for the operating console of each cabin to be separated by spaced, removable posts anchored in the floor from the roadway between the cabin rows. This open embodiment improves communication within the test hall and also safeguards the operators at the consoles from transport vehicles moving behind them to assemble and dismantle x-ray systems in other radiation protection cabins.

BRIEF DESCRIPTION OF THE DRAWINGS

Further advantages, features and details of the invention are produced by the subsequent description of an exemplary embodiment as well as by reference to the drawing. The diagrams show.

DETAILED DESCRIPTION OF INVENTION

Figure 1:
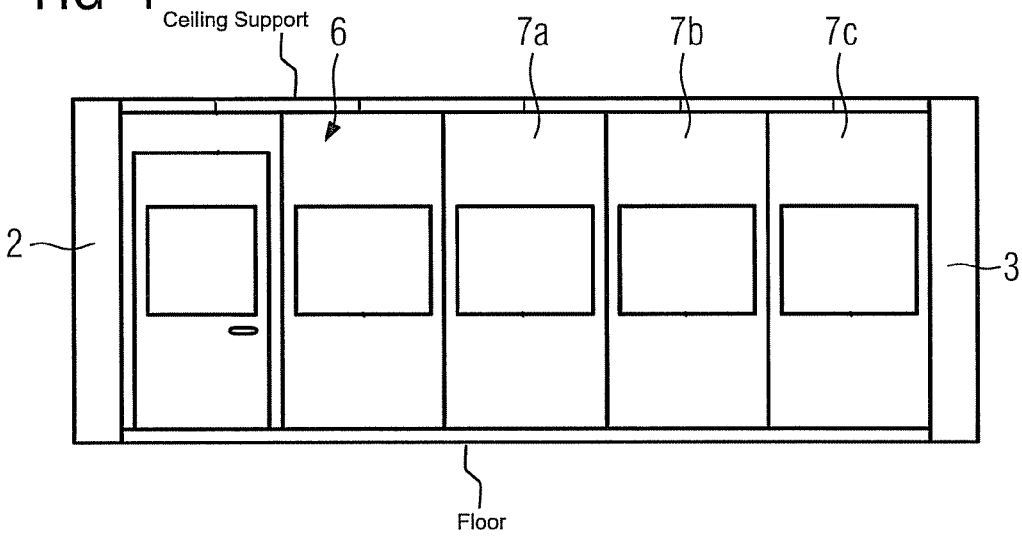
FIG. 1 a schematic view of an inventive x-ray protection cabin without the ceiling construction arranged above it, FIG. 2 a view of the radiation protection cabin, again without the ceiling construction arranged above it, composed of transverse mounting rails and FIG. 3 a basic diagram of the sliding door overlapping with the lead lining, with the door elements being shown as exaggeratedly thick.
Figure 2:
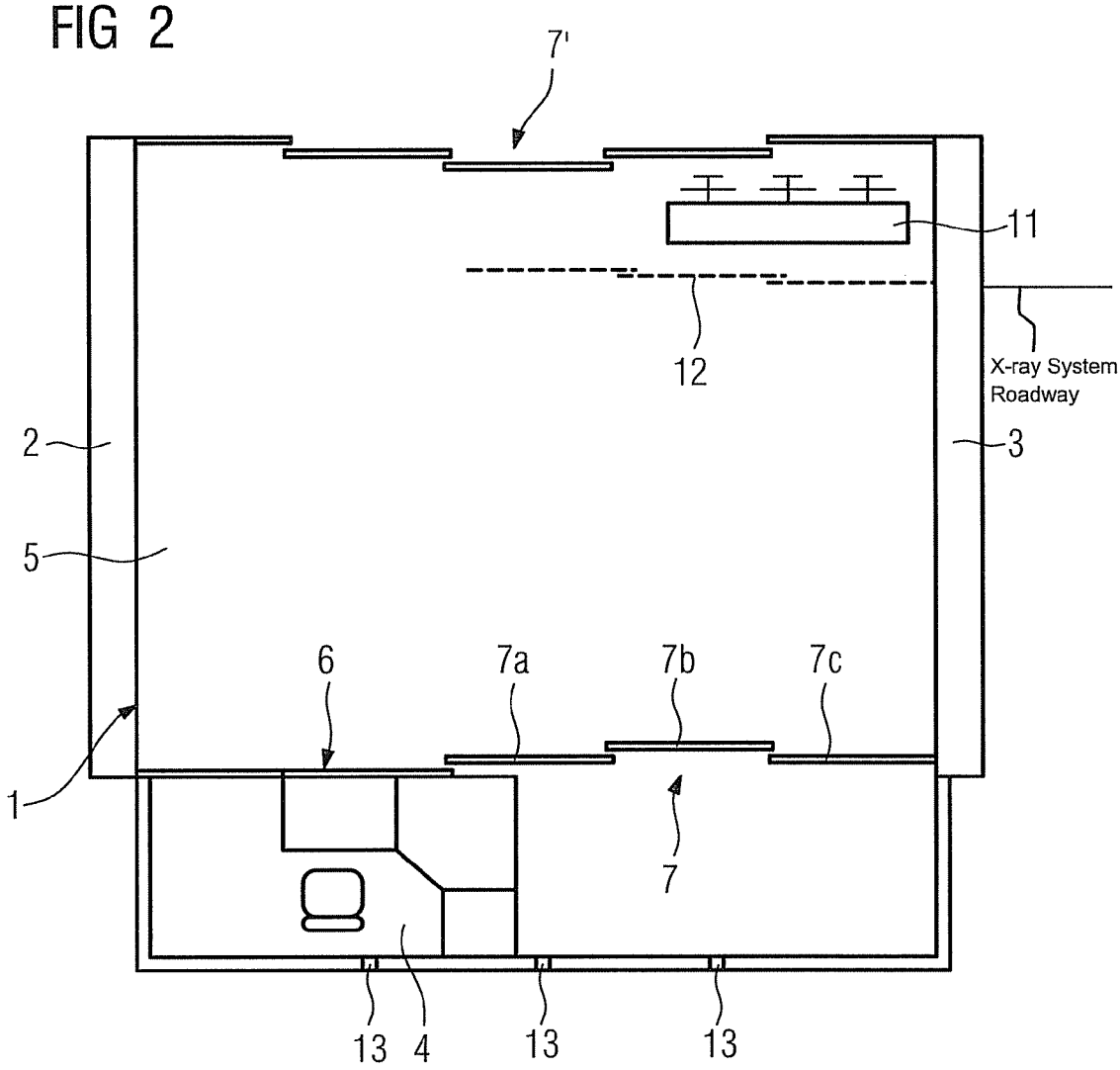
Figure 3:
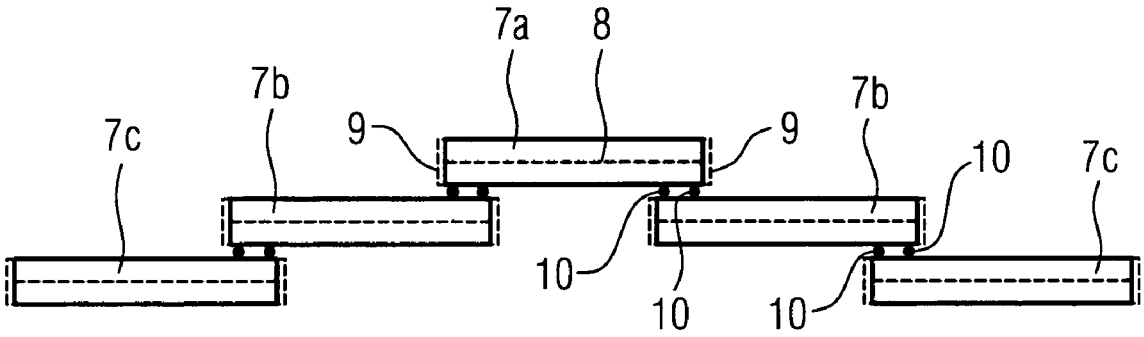

The radiation protection cabin 1 depicted in FIGS. 1 and 2 comprises two rigid radiation-proof side walls 2 and 3. The operating console 4 in front of the cabin 1 is shielded by a largely open construction from the interior 5 which consists of a fixed part 6 and a sliding door 7, in the exemplary embodiment shown in FIG. 2, consisting of three door elements 7*a*, 7*b* and 7*c*. The door elements 7*a*, 7*b*, 7*c* comprise, as can be seen in particular from FIG. 3, as well as the interior lead plate 8 also lead-lined side edges 9, with the door being embodied so that, when the sliding door is in the completely closed state, the individual elements 7*a*, 7*b*, 7*c* overlap so much that it is entirely impossible for x-ray radiation coming from any point in the interior 5 of the radiation protection cabin to penetrate into the outside area through the gap between two overlapping door elements 7*a*, 7*b*, 7*c*. The door elements 7*a*, 7*b*, 7*c*are hung on the ceiling construction so that they slide freely and end at a short distance from the floor, making them very easy and smooth to slide. The sealing profiles 10 shown schematically in FIG. 3 and running along the lead-lined side edges 9 of the door elements 7*a*, 7*b*, 7*c* can have contacts built into them which, for monitoring that the door elements are fully closed and thus that the interior 5 of the radiation protection cabin is hermetically sealed, can be linked to a closure monitoring device, which in its turn is connected to the operating system of the x-ray system. Only when all doors are really closed is the x-ray system within the cabin allowed to be put into operation.

In practice a plurality of radiation protection cabins 1, as shown in FIGS. 1 and 2, are arranged in rows next to one another and in addition in a second row behind the first one, with the facing rear walls of these two rows of radiation protection cells also being able to be closed by sliding doors 7'. Embodying the rear wall as a sliding door 7' in this way, which is opposite a corresponding sliding door 7', of the cabin of the row behind it, allows power supply to the system from the rear.

The number 11 indicates the system cabinets which can be arranged in the area of the rear wall of the cabin 1 protected behind lead curtains 12 shown by dashed lines in the diagram. The number 13 shows the removable posts anchored in the floor, to protect the operating console of the cabin 1 from the roadway behind it, or in the case of FIG. 2, below the diagram, running along the row of radiation protection cabins.

The invention claimed is:

1. A facility for installing and system testing of a floor- or ceiling-mountable x-ray system, comprising:

a plurality of adjoining radiation protection cabins each having radiation-proof walls and doors for housing an x-ray system for testing;

a door closure monitoring system operatively connected to an operating system of the x-ray system; and a plurality of sliding doors each assigned to one of the radiation protection cabins, wherein wherein the door elements overlap in an inwardly tiered manner from the respective radiation protection cabin such that a most inward door element contacts two side edges on two respective laterally adjacent next outward door elements and each of the next outward door elements in turn contacts two side edges on two respective laterally adjacent door elements or one adjacent door element and one wall, the sliding doors each include a plurality of lead-shielded door elements telescopically sliding over one another, the door elements have lead-shielded side edges overlapping in a closed position so that no gap between two adjacent door elements occurs for preventing radiation from escaping from an internal operating space of the radiation protection cabin, wherein the sliding doors are mounted at and hung from a ceiling support and their lower ends nearly reach but do not touch a floor of the facility such that they are adapted to slide freely and separate an internal operating space of each radiation protection cabin from an x-ray system operating console arranged in front of the respective radiation protection cabin, wherein the sliding doors each comprise at least three elements telescopically configured to extend or retract, wherein the door elements overlap in an inwardly tiered manner from the respective radiation protection cabin such that a most outward door element contacts two side edges on two respective laterally adjacent next outward door elements and each of the next outward door elements in turn contacts two side edges on two respective laterally adjacent subsequent door elements, wherein the door elements are adapted to slide freely, wherein the door elements are operatively connected to the door closure monitoring system for monitoring that the door elements are fully closed, and wherein the x-ray system is allowed to be operated only when all door elements are fully closed.

2. The facility according to claim 1, wherein the walls and doors of the radiation protection cabins are armed with lead.

3. The facility in accordance with claim 1, wherein the cabin wall having the sliding door comprises at least one lead-shielded fixed door part including a swing door.

4. The facility in accordance with claim 1, wherein at least one door element comprises a lead glass window.

5. The facility in accordance with claim 3, wherein the swing door comprises a lead glass window.

6. The facility in accordance with claim 1, wherein the radiation protection cabins are arranged in double rows, the radiation protection cabins arranged next to one another or one behind the other.

7. The facility in accordance with claim 6, wherein rear walls of radiation protection cabins facing one another are provided with the sliding doors.

8. The facility in accordance with claim 7, wherein the radiation protection cabins have no ceiling and are spanned by the ceiling support.

9. The facility in accordance with claim 7, wherein system cabinets assigned to the x-ray system are arranged behind slidable lead curtains near at least one of the rear walls.

10. The facility in accordance with claim 1, wherein the operating console is separated from an x-ray system roadway.

11. The facility in accordance with claim 10, wherein the radiation protection cabins are arranged in rows and the x-ray system roadway is located between two of the rows.

12. The facility in accordance with claim 11, wherein the operating console is separated from the x-ray system roadway by a plurality of removable posts arranged at a distance from one another and anchored in the floor.

* * * * *